United States Patent [19]

Butler

[11] Patent Number: 4,649,730

[45] Date of Patent: Mar. 17, 1987

[54] AUTOMOBILE BODY AND FRAME STRAIGHTENING TOOL

[76] Inventor: David Butler, 3924 Melrose Ave., Erie, Pa. 16509

[21] Appl. No.: 761,827

[22] Filed: Aug. 2, 1985

[51] Int. Cl.[4] ..... B21D 1/12

[52] U.S. Cl. ..... 72/308; 72/705

[58] Field of Search ..... 72/705, 308; 293/116, 293/117

[56] References Cited

U.S. PATENT DOCUMENTS 4,296,626 10/1981 Jarman et al. ..... 72/705

OTHER PUBLICATIONS

"Kansas Jack Collision Repair Equipment" by Kansas Jack Inc., McPherson, Kans., pp. 7 and 8, Jan. 1982.

*Primary Examiner*—Lowell A. Larson

*Attorney, Agent, or Firm*—Ralph Hammar

[57] ABSTRACT

A tool for exerting tension through the automobile bumper shock absorber to pull frames and bodies into design position after a crash.

7 Claims, 5 Drawing Figures

AUTOMOBILE BODY AND FRAME STRAIGHTENING TOOL

This invention is a tool for pulling automobile frames back into shape after a crash. The tool is very helpful for unibody construction where the body and frame are welded together.

Figure 1:
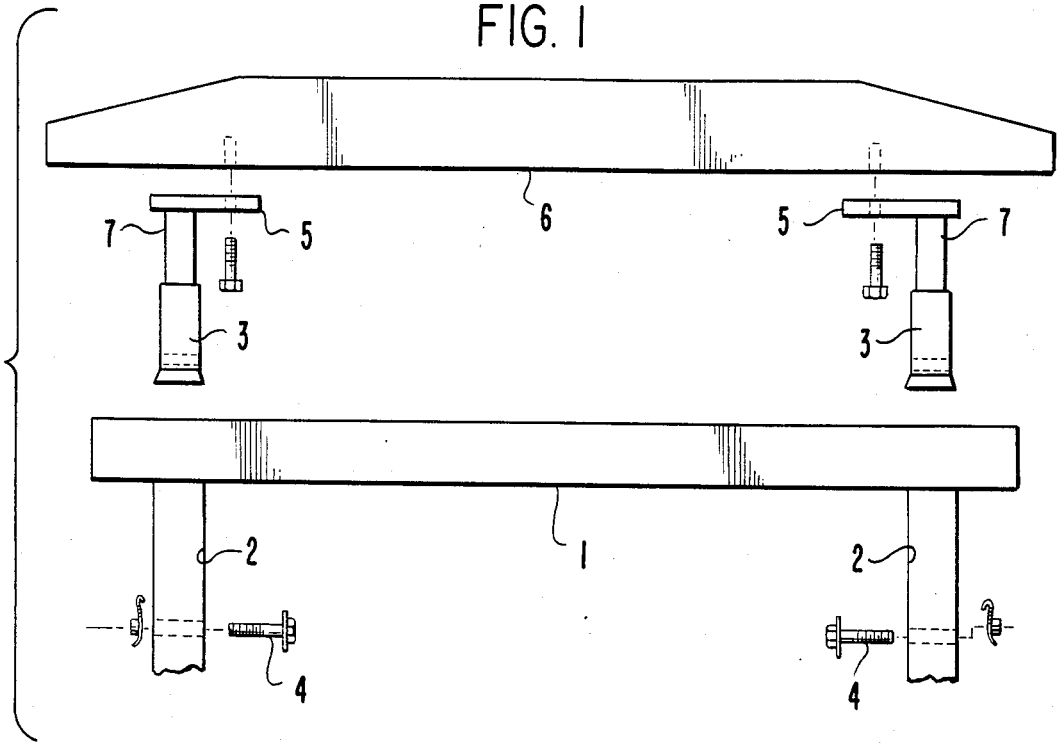
FIG. 1 is an exploded view of the front end of an automobile frame.

In typical automobile construction, the front end of the frame has a cross member 1 and sockets 2 for shock absorbers 3. The back ends of the shock absorbers may be bolted in place by through bolts 4 at the bottom of the sockets 2. At the forward end of the shock absorbers are brackets 5 bolted to a bumper structure 6 which typically comprises an inner structural member for receiving the load and outer decorative member which is for appearance. The brackets 5 are sometimes dispensed with and the front end 7 of the shock absorbers are connected directly to the structural member of the bumper 6. A similar shock absorber structure is used for the bumper at the back end of the automobile.

Even in severe crashes, the shock absorber sockets are not seriously distorted. The sockets are designed to receive heavy loads and to transmit the same to the frame and body of the car. While the frame and body may be distorted by the crash, the shock absorbers by reason of the inherent design are not distorted.

Figure 3:
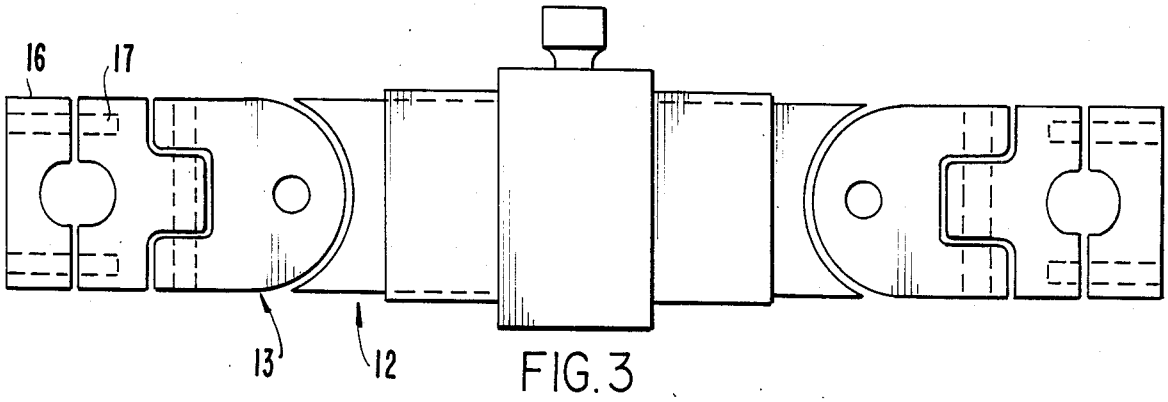
FIG. 3 is a plan view of an extensible bar for connecting two tools.
Figure 4:
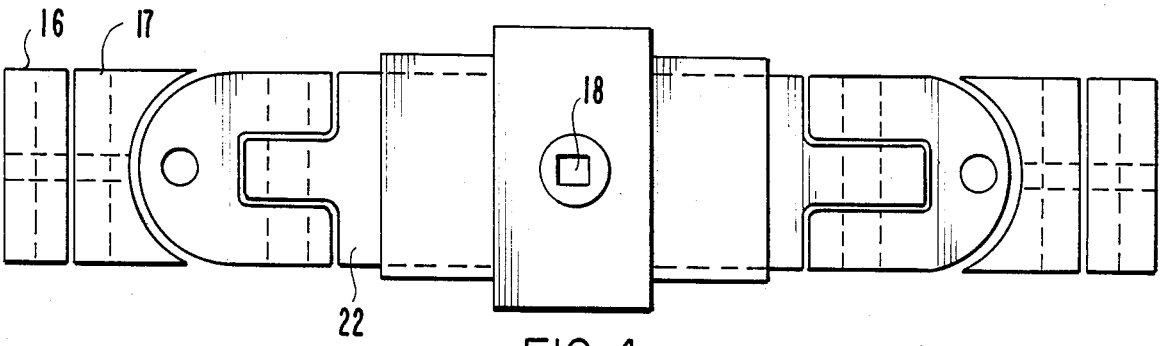
FIG. 4 is an elevation of FIG. 3.
Figure 5:
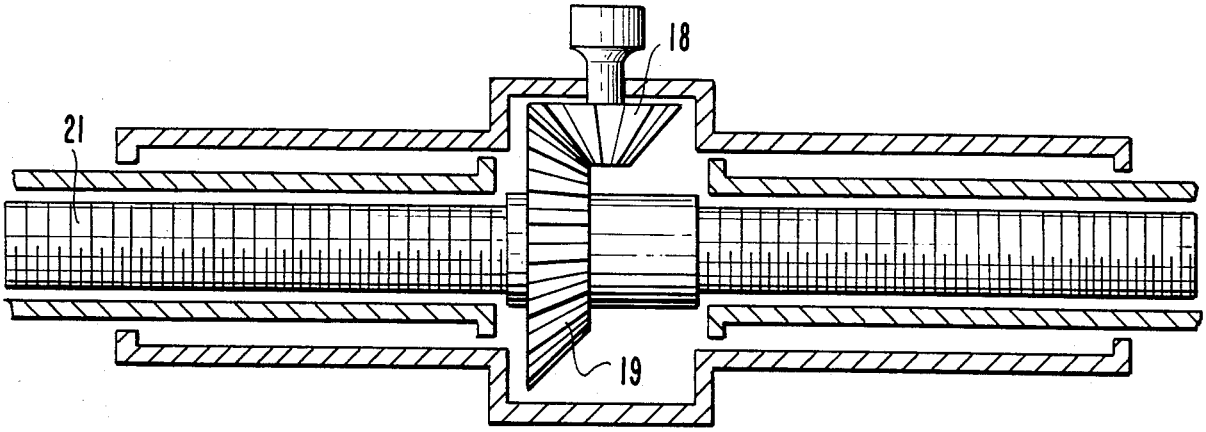
FIG. 5 is a diagrammatic view of the drive for extending the bar of FIGS. 3 and 4.

The first step in straightening an automobile frame after a crash is to remove the shock absorbers 3 by removing the bolts 4 and if necessary, also removing or disconnecting the brackets 5 from the bumper 6. The next step is to insert a pulling tool 8 in each socket and secure it in place by suitable means such as bolts 9 and washers 10. The pulling tools will rarely be in the rectilinear position illustrated because of the distortion due to the crash. It is desirable that at the end of the straightening operation the pulling tools 8 be in line with (or parallel to) the frame members 11 and that the spacing between front members 11 be within design tolerance. This is accomplished by the direction of pull on the tools 8 and by extensible bar 12 shown in detail in FIGS. 3, 4 and 5. The bar 12 has universal joints 13 at each end which are clamped over flats 14 by screws 15 extending from clamping member 16 into universal joint member 17 so as to accurately position the universal joint with respect to the tool 8. The length of the bar 12 is adjusted by gears 18, 19 driving an oppositely threaded shaft 21 connected to universal joint members 22.

Figure 2:
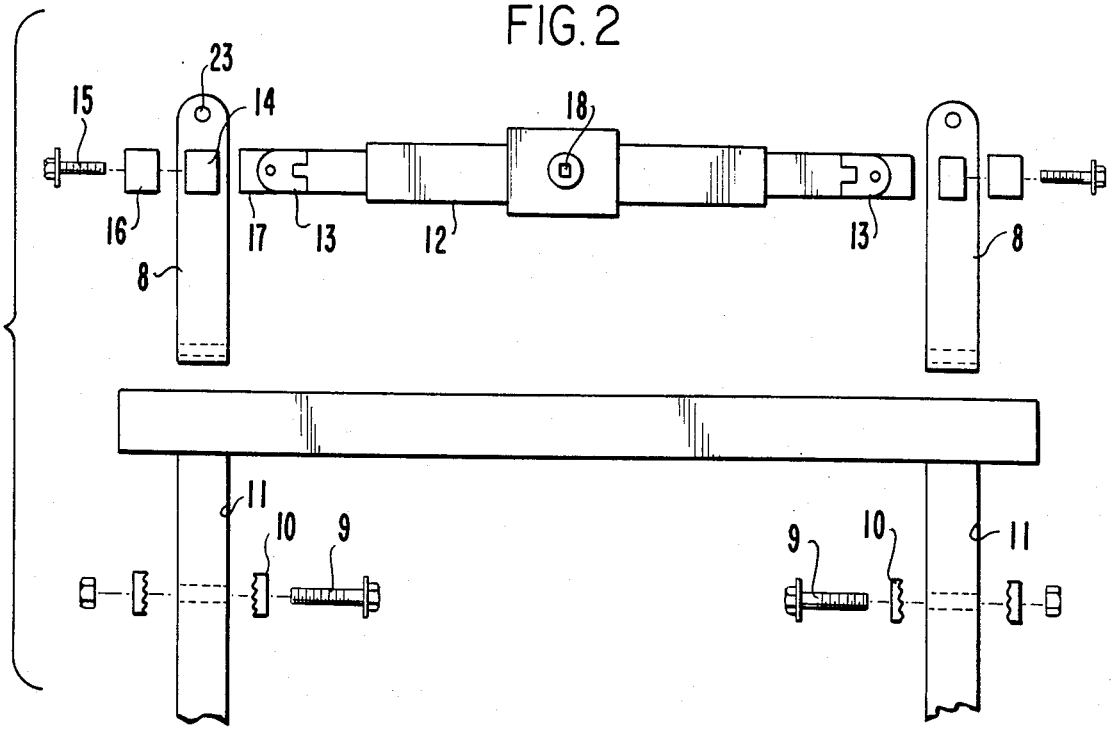
FIG. 2 is an exploded view of the front end of the frame and the frame straightening tool.

Each of the pulling tools 8 has an eye 23 which permits pulling in any direction. By varying the direction and amount of pull, it is possible to bring even a badly damaged frame back into the rectilinear relationship indicated in FIGS. 1 and 2. This straightening of the frame also straightens parts of the body which were damaged by the crash. This straightening is desirable even though the damaged parts of the body are to be replaced. The damaged parts provide a convenient way of transmitting force to other parts of the body which are not to be replaced.

I claim:

1. A tool for straightening unibody automobile frames with energy absorber type bumpers, said tool having an inner end substituted in the bumper energy absorber mount in the same thrust relation to the frame as the energy absorber is replaced, said tool having an outer end for attachment to a pulling means for exerting a pull on the outer end of the tool for straightening.

2. A tool for straightening unibody automobile frames with a bumper of the type having two energy absorbers one on each side of the longitudinal axis of and in thrust relation between the bumper and the frame, and a tool according to claim 1 substituted for each energy absorber.

3. The tool of claim 2 plus an extensible (and contractable) bar connected between said tools for indicating the distance between said tools and when the frame being straightened becomes angularly and dimensionally restored to design requirements.

4. The tool of claim 3 in which one end of the bar is connected through a universal joint.

5. The tool of claim 3 in which both ends of the bar are connected to the tool by universal joints.

6. The method of securing a tool to a vehicle structure of the type having a bumper mounted on said structure by an energy absorber means for the purpose of straightening damage after an impact comprising the steps of:

removing the bumper and energy absorber means, securing said tool to said structure in place of said bumper and energy absorber means, attaching said tool to pulling means.

7. A tool for the purpose of straightening a vehicle structure back to design specifications, said vehicle structure having an energy absorbing bumper having energy absorbing means and a mounting means in thrust relation to said structure for said energy absorbing means, a bumper carried by said energy absorbing means, said tool upon removal of said bumper and said energy absorbing means, having an inner end configured to be substituted for said energy absorbing means and to be attached to said mounting means and said tool having its outer end configured for attachment to a pulling means.

* * * * *

UNITED STATES PATENT AND TRADEMARK OFFICE

CERTIFICATE OF CORRECTION

PATENT NO. : 4,649,730

DATED : March 17, 1987

INVENTOR(S) : David Butler

It is certified that error appears in the above-identified patent and that said Letters Patent is hereby corrected as shown below:

In Column 2, Claim 1, line 17, "is" should be "it"

Signed and Sealed this

Tenth Day of September, 1991

*Attest:*

*Attesting Officer*

HARRY F. MANBECK, JR.

*Commissioner of Patents and Trademarks*